United States Patent [19]

de Wit et al.

[11] 4,114,673

[45] Sep. 19, 1978

[54] LOCKING MECHANISM FOR VERTICAL SLAT BLIND

[75] Inventors: Hendrik de Wit, Rotterdam; Kurt Heinz Frentzel, Zevenhoven, both of Netherlands

[73] Assignee: Hunter Douglas International N.V., Curacao, Netherlands Antilles

[21] Appl. No.: 782,316

[22] Filed: Mar. 29, 1977

[30] Foreign Application Priority Data

Mar. 31, 1976 [DE] Fed. Rep. of Germany ..... 2613750

[51] Int. Cl.[2] ..... E06B 9/26

[52] U.S. Cl. ..... 160/166 A; 160/168 R; 160/173

[58] Field of Search ..... 160/166–178; 292/125, 133, 246

[56] References Cited

U.S. PATENT DOCUMENTS

| | | | |
|---|---|---|---|
| 2,607,409 | 8/1952 | Suirsky | 160/166 A |
| 2,755,854 | 7/1956 | McIntire | 160/166 A |

FOREIGN PATENT DOCUMENTS

| | | | |
|---|---|---|---|
| 8,883 | 5/1892 | United Kingdom | 292/125 |

*Primary Examiner*—Peter M. Caun

*Attorney, Agent, or Firm*—Pennie & Edmonds

[57] ABSTRACT

The invention relates to a locking mechanism for a vertically slatted blind. The locking mechanism rides in the top rail which also supports the slats. The locking mechanism is operated by flexible tension members.

8 Claims, 5 Drawing Figures

LOCKING MECHANISM FOR VERTICAL SLAT BLIND

PRIOR ART

In conventional vertically slatted blinds, the slats are not secured after being drawn apart into their final position, that is, in the absence of sustained retention by a tension member, they may be displaced from their intended position by outside influences such as, for example, a draft of air.

The object of the invention is to forestall this possibility and so construct a vertically slatted blind in which the slats can be fixed in their spaced final position.

BRIEF DESCRIPTION OF THE IVENTION

To accomplish this object, it is proposed according to the invention that the last slat be associated with a locking means acted upon by the flexible tension members which operate from opposed directions. The locking means has a hook entering behind a stop fixed to the end of the top rail, the slats are connected to each other and to the locking means by a flexible connecting member, the locking means has on each side at least one bottom guide tab entering under the associated guide flange of the rail and one top guide tab entering over it, the point of purchase of both tension members acting on the locking means are located higher than the top guide tab, the point of purchase of the locking tension member acting from the direction of the hook is located lower than the point of purchase of the other unlocking tension member, the point of purchase of the connecting member is located lower than the top guide tab, and the top and bottom guide tabs are so fashioned and arranged that the locking means is capable of executing a tilting movement permitting engagement and disengagement with the stop.

With the aid of the locking means, it is possible to fix the slats in their spaced position. Thus the slats can retain that position even under some outside influence. By way of the tension members acting upon it and the connecting member, the locking means can execute the tilting movements required to hook and unhook the engagement. The locking tension member acting on the locking means from the direction of the hook acts thereon at such a height that the locking means can be drawn past the stop fixed to the end of the top rail and become engaged. Then if this locking tension member is relieved of tension, the locking means can be subjected by way of the connecting member leading to the last slat to a stress sufficient to impose a tilting moment, since the point of purchase of the connecting member is lower than the top guide tab, the engagement of the hook behind the stop remains assured. If the unlocking tension member acting from the direction of the last slat is subjected to load, it exerts a torque, since its point of purchase is higher than the top guide tab, such that the engagement is unhooked again. In any case, the locking means continues to be positively guided on the top rail owing to the supplementary action of the bottom guide tab.

It will be understood by those skilled in the art that where mention is made here of two tension members acting from opposed directions, in practice of course a single tension member continuing past the locking means may be employed, to be pulled alternately in one direction or the other; such a tension member may be in the form of a chain, cord or the like In further refinement of the invention, it is proposed that the locking means have two bottom guide tabs on each side, one displaced from the top guide tab towards the last slat and the other towards the hook, and that a vertical clearance limiting the tilting movement of the locking means be provided between the bottom guide tab towards the hook and the top guide tab. The upward tilting movement of the locking means, in other words, may be limited by the bottom guide tab nearest the hook.

It is proposed further that a vertical spacer be formed on the locking means, the unlocking tension member acting from the direction of the last slat being passed around its upper edge and the connecting member around its lower edge. Then the top edge is the point of purchase of the unlocking tension member acting from the direction of the last slat, while the bottom edge is the point of purchase of the connecting member on the locking means.

The construction of the locking means is further simplified if, according to a further proposal of the invention, a U-shaped anchorage, open upward, is formed at the upper end of the spacer, if the connecting member is passed from the bottom edge of the spacer along its inner side and over the top edge into the anchorage, and if the unlocking tension member acting from the direction of the last slat is placed in the anchorage over the connecting member. This tension member and the connecting member, in other words, may both be respectively guided and secured in the anchorage, permitting simple assembly. It is favorable also if at least one leg of the U-shaped anchorage is provided with a retaining lug on the inside, gripping the unlocking tension member acting from the direction of the last slat, so that after being secured, it cannot escape from the anchorage of its own accord.

Advantageously also, the spacer may be arranged in the region of the bottom guide tab towards the last slat, the locking means may have a vertical web in the region of the bottom guide tab towards the hook, the locking tension member acting from the direction of the hook being passed over the upper edge thereof, and both tension members may be passed into and secured in the space located between the web and the spacer. Thus the upper edge of the web is the point of purchase of the locking tension member acting from the direction of the hook.

BRIEF DESCRIPTION OF THE DRAWINGS

The construction of the device of this invention will be apparent from the following description and the accompanying drawings in which.

Figure 1:
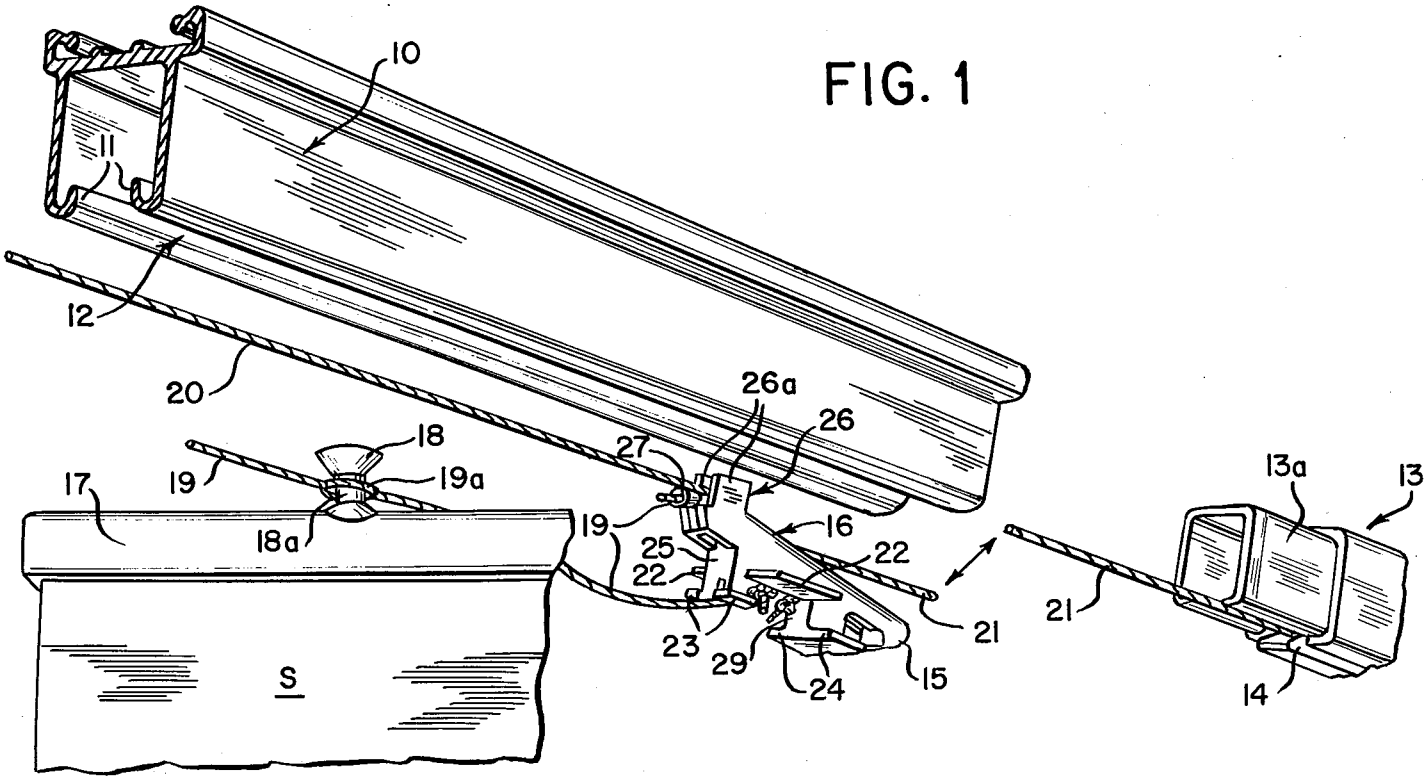
FIG. 1 shows a segment of a top rail with an end piece, the locking means and the support of the last slat, in an exploded perspective view.

A top rail 10 has on its under side two guide flanges 11 pointing inward, bounding a track 12. An end piece 13 has a reduced portion at 13*a*, at the end towards the top rail, so that it may be inserted into the top rail 10. On the under side of the end piece 13 there is a stop 14 t be engaged by a hook 15 of a locking means 16.

From the guide flanges 11, a plurality of individual slats S each hang by a support 17, only one of which (the last one closest to the locking means) is shown here, its head 18 being capable of being inserted in the track 12 so that it is suspended by the guide flanges 11.

Figure 2:
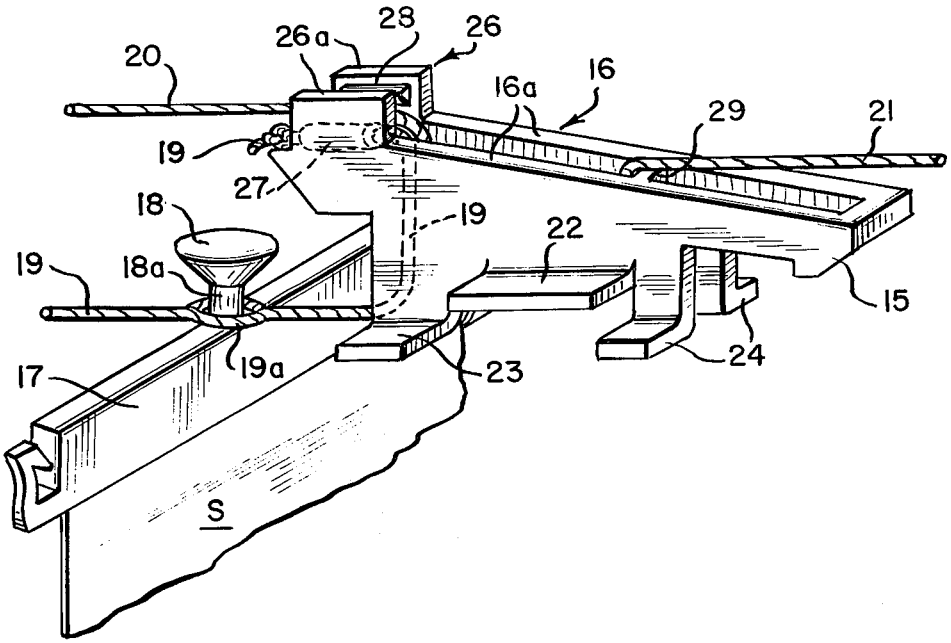
FIG. 2 shows a perspective view of the locking means with tension members and connecting member.

The support 17 is connected to the other like slat supports not shown and to the locking means 16 by a connecting member 19 in the form of a cord. Each slat support is connected to the cord 19 at equally spaced intervals therealong by element **19*a* (FIGS. 2 and 3) secured to cord 19 and passing around the reduced stem 18*a* of the head 18. Element 19*a* may be one strand or more of cord 19** slightly untwisted for the purpose or a clip or the like all as is well known in the art.

From the direction of the support 17 of the last slat S (i.e., from the left in FIG. 1), a tension member 20 acts on the locking means 16 in a direction to unlock the same, while an additional tension member 21 acts upon it from the direction of the hook 15 (i.e., from the right in FIG. 1) to engage or lock the same. Tension members 20 and 21, as will be apparent, also serve to move locking means 16 and thus the slat support 17 along the track in either direction.

The locking means 16 is constructed as follows in detail.

On each side, a pair of top guide tabs 22 are arranged, by which the locking means 16 can rest on top of the guide flanges 11. Preceding and following the top guide tabs 22, the locking means 16 has bottom guide tabs 23 and 24 on each side, entering under the guide flanges 11. The anterior guide tabs 24, towards the hook 15, have a greater vertical clearance from the under side of the guide tab 22 than the bottom guide tabs 23 towards the slat support 17, so that the top guide tabs 22 and the bottom guide tabs 24 preassign a definite range of tilt for the locking means 16 as will be apparent hereinafter.

Figure 3:
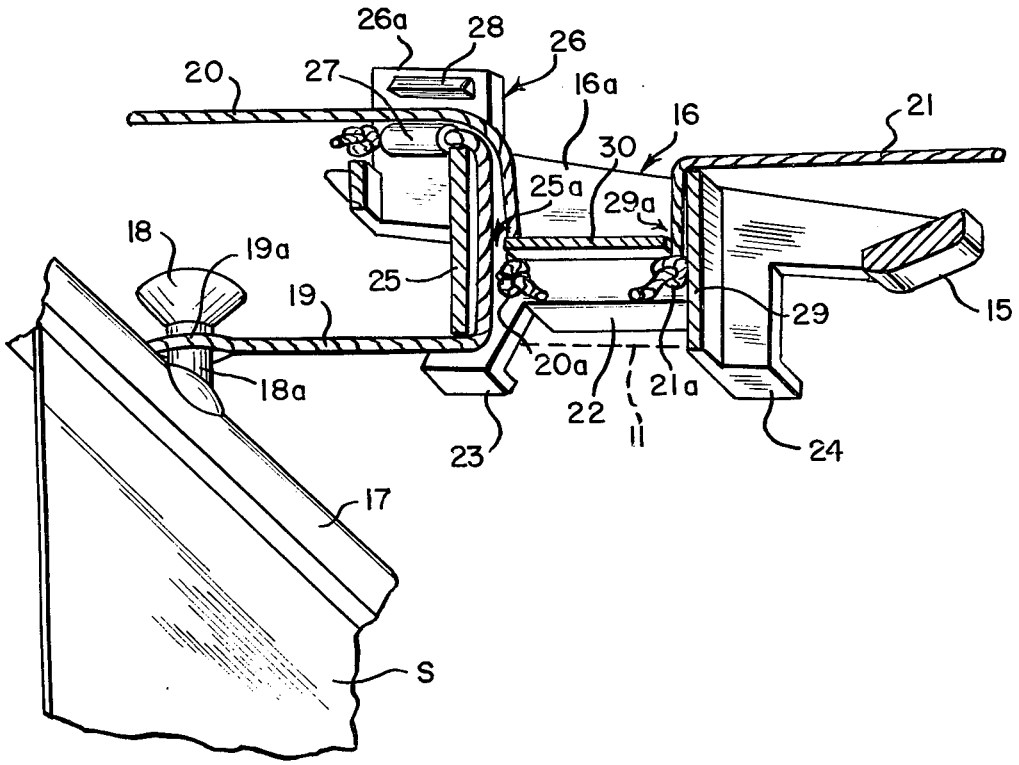
FIG. 3 shows a perspective view of the locking means partly in cross section.
Figure 4:
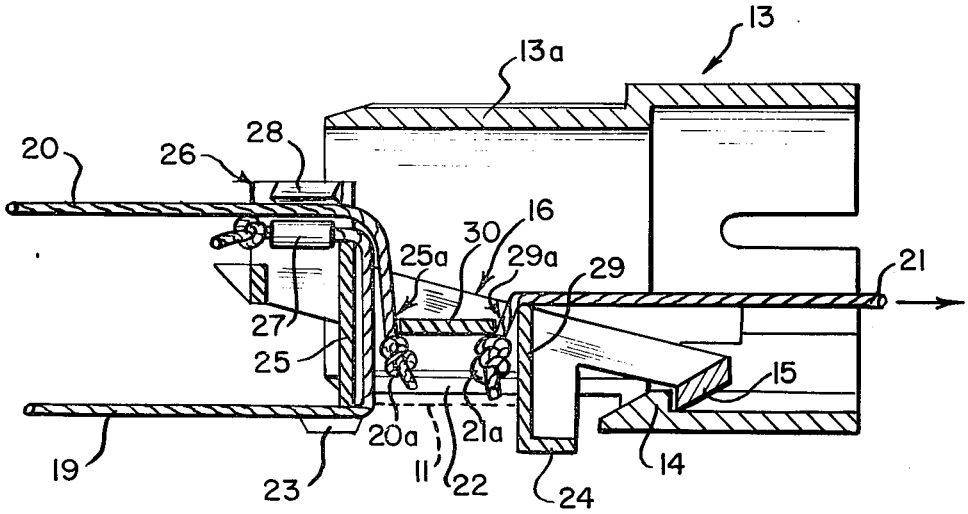
FIG. 4 shows a section of the locking means and the end piece of the top rail with hook engaged.
Figure 5:
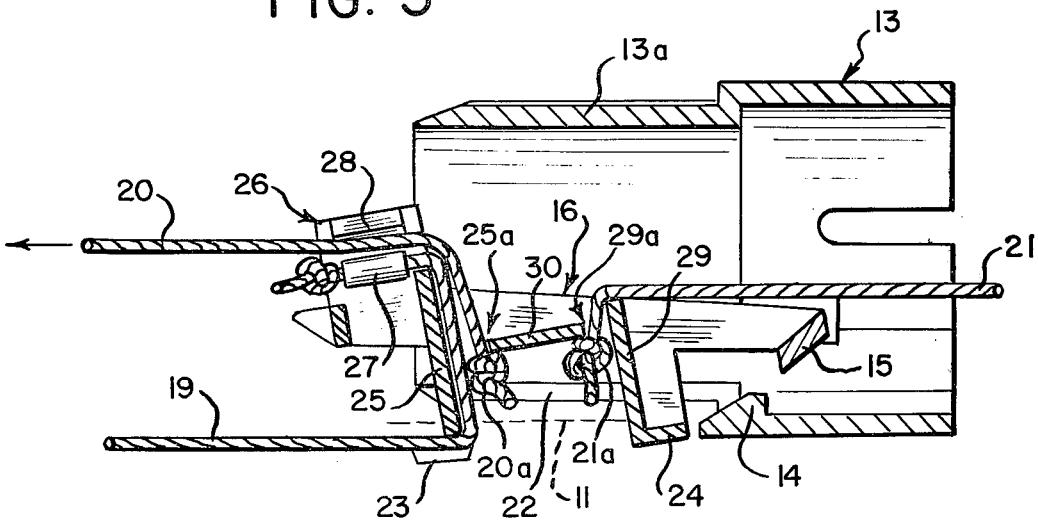
FIG. 5 shows a view similar to FIG. 4 with hook disengaged.

The internal construction of the locking means 16 is best seen in FIGS. 3 to 5. In the region of the bottom guide tabs 23, a spacer 25 extends vertically upward, forming a posterior transverse wall for the locking means 16. The connecting member 19 is passed around the bottom edge of the spacer 25 and runs along the inside to the top of spacer 25. Thence it is led back into the interior of a U-shaped anchorage 26 formed by two legs **26*a* extending upward. The connecting member 19 is secured by a sleeve 27 secured adjacent the end of connecting member 19. The sleeve 27 may be of metal squeezed tightly about member 19 though other materials and arrangements will be apparent to those skilled in the art. The sleeve 27 is positioned behind the top edge of spacer 25. It is forced against the latter by tension in the member 19 and is also held in position by the tension member 20 which lies on top of connecting member 19 and passes between the legs 26*a* of the anchorage 26 and kept from slipping out by a retaining lug 28 on the inside of each of the legs 26*a***.

In the region of the anterior bottom guide tabs 24, a web 29 extends perpendicularly upward, forming an anterior transverse wall of the locking means 16. The locking tension member 21 acting from the direction of the hook 15 is passed over the top edge of the web 29, so that the top edge forms its point of purchase.

A horizontal web 30 extends between the interior facing surfaces of side walls **16*a* of the locking member 16. The web 30 is spaced from walls 25 and 29 providing spaces 25*a* and 29*a* which receive therethrough tension members 21 and 20 respectively. Knots 21*a* and 20*a* hold tension members 21 and 20 in position as shown. Connecting member 19 also passes through space 25*a*** as shown.

The locking means 16 has the following functions in detail.

When the locking means is moved towards the end piece 13 by the tension member 21, the slats S attached to the supports 17 are pulled in the same direction by virtue of their connection to the locking member 16 through connecting member 19. The top edge of web 29 is the purchase point for the tension member 21 on locking means 16. Since this purchase point permits at least a slight upward tilt of the locking means 16 counterclockwise in FIGS. 2–5) the hook 15 is easily drawn over the stop 14 and engaged. Then after relief of the tension member 21, if for any reason some unintentional force is exerted on the slats in the opposite direction, the force exerted on the locking means 16 by way of the connecting member 19 (in which some residual tension remains) will suffice to hold the hook 15 of the locking means 16 in the position of engagement shown in FIG. 4 by reason of the purchase provided by the bottom edge of spacer 25, while the top guide tabs 22 of the locking means 16 rest against the guide flanges 11. The residual tension in connecting member 19 biases the locking member 16 in a clockwise direction as viewed in FIGS. 2–5. The locking means 16 is thus securely hooked to the end piece 13. During these operations, no substantial load is applied to the locking means 16 by way of tension member 20.

If tension member 20 is stressed to unhook the engagement and retract the slats, a torque is exerted on the locking means by way of the purchase at the top edge of spacer 25 where the tension member 20 bears on top of the return end of the connecting member 19. Tension applied to member 20 to unhook the hook 15 is greater than any remaining residual torque emanating from the connecting member 19 in the opposite direction.

With top guide tabs 22 resting against the guide flanges 11, the locking means 16 is tilted upward (counterclockwise in FIGS. 2–5) until the bottom guide tabs 24 come into contact with the guide flanges 11. In this position, the hook 15 is freed from the stop 14, and the locking means 16 and the slats may be retracted by the tension member 20.

We claim:

1. In a slatted blind having a plurality of vertical slats, a top rail, opposed guide flanges on said top rail defining a track groove and slat supports supported by said guide flanges in said track groove for supporting said vertical slats, the improvement comprising a locking means, means connecting said slats to each other, said connecting means also connecting the locking means to the last slat of said blind, a hook extending from said locking means in one direction away from said last slat, a stop fixed to the top rail, said locking means being engaged in said track for movement therealong, said locking means also being tiltable with respect to said top rail, tension means engaged with said locking means for moving said locking means along said track in either direction, said locking means upon movement by said tension means in said one direction bringing the hook of said locking means into contact with said stop on said top rail and upon continued movement in said one direction said locking means tilting to lockingly engage said hook in said stop of the top rail, and said connecting means when said hook is lockingly engaged in said stop biasing said locking means in a direction to maintain said locking engagement whereby the slats of said blind are maintained in their spaced relationship.

2. The article of claim 1 in which upon movement of said tension means in a direction opposite to said one direction the bias of said connecting means is overcome and said locking member is tilted to disengage said hook from said stop whereby said locking member and slats may be retracted.

3. The article of claim 2 in which the engagement of said locking means in said track includes at least one top guide tab on said locking means extending laterally thereof and above one of said opposed guide flanges for engagement therewith.

4. The article of claim 3 in which said locking means includes at least one bottom guide tab extending laterally of said locking means and beneath one of said opposed guide flanges.

5. the article of claim 4 in which said top and bottom guide tabs define the tilting range of said locking means by their respective engagement with an opposed guide flange.

6. The article of claim 5 in which the points of purchase of said tension means on said locking means when applying force thereto to move the same along said track are above said top guide tab.

7. The article of claim 6 in which the point of purchase of said connecting means on said locking means is below said top guide tab.

8. The article of claim 7 in which the point of purchase of said tension means on said locking means when applying tension thereto to lockingly engage said hook in said stop is below the point of purchase of said tension means on said locking means when applying tension thereto to disengage said hook from said stop.

* * * * *